United States Patent [19]

Maruyama et al.

[11] Patent Number: 4,756,636

[45] Date of Patent: Jul. 12, 1988

[54] PRINTER WITH AUTOMATIC PRINT-MODE SETTING DEVICE

[75] Inventors: Satoru Maruyama; Yasushi Kawakami, both of Nagoya; Fukue Obata, Yokkaichi; Ryuhei Mano, Nagoya, all of Japan

[73] Assignee: Brother Kogyo Kabushiki Kaisha, Aichi, Japan

[21] Appl. No.: 916,555

[22] Filed: Oct. 8, 1986

[30] Foreign Application Priority Data

Oct. 14, 1985 [JP] Japan ..... 60-156845[U]

[51] Int. Cl.[4] ..... G41J 13/00

[52] U.S. Cl. ..... 400/624; 400/605

[58] Field of Search ..... 400/624–629, 400/54, 16, 17, 605; 271/9

[56] References Cited

U.S. PATENT DOCUMENTS 4,411,540 10/1983 Nozaki et al. ..... 900/54
4,473,314 9/1984 Imaizumi ..... 400/629
4,577,984 3/1986 Yamamoto et al. ..... 400/629
4,590,297 9/1986 Imaizumi et al. ..... 400/265
4,627,748 12/1986 Mizuno et al. ..... 400/17
4,663,722 5/1987 Sato ..... 271/9

*Primary Examiner*—William Pieprz
*Attorney, Agent, or Firm*—Parkhurst & Oliff

[57] ABSTRACT

A printer adapted to be optionally equipped with a sheet feeder, including a detector for detecting the installation of the sheet feeder, and a default-value setter for automatically setting a default value of a printing controller to a value for establishing a continous printing mode if the sheet feeder is installed, and for automatically setting the default value to a value for establishing a single-page printing mode if the sheet feeder is not installed. The printer further includes an operator-controlled default-value changeover device for changing the normally selected printing mode set by the default-value setter. In the continuous printing mode, cut sheets are continuously supplied one after another to the printer. In the single-page printing mode, the printing operation is stopped at the end of printing on each cut sheet.

7 Claims, 4 Drawing Sheets

<Print condition menu>

1. Pause after each page: N (or Y)
2. Start from page / to page:
3. Number of copies :
4. No more changes

PRINTER WITH AUTOMATIC PRINT-MODE SETTING DEVICE

BACKGROUND OF THE INVENTION

1. Field of the Invention

The present invention relates to a device for automatically establishing a print mode in a printer which is adapted to be equipped with an optionally available cut-sheet feeder.

2. Discussion of the Prior Art

In a known printer for printing on cut sheets of a predetermined size, the printing operation is generally effected in one of two modes: a single-page mode in which the printer is stopped after the completion of printing of the last line of a page; and a continuous mode in which the printer automatically starts a "top-of-form" action after the printing of the last line on one sheet, to bring another sheet into printing position for printing thereon, thereby permitting a continuous printing operation on successive sheets.

In the case where a printer is equipped with a sheet feeder for automatically loading the printer with cut sheets one after another, the continuous printing mode is desirable and convenient. In this case, however, there are some occasions to print in the single-page mode. On the other hand, if the printer is not equipped with a sheet feeder, and the printer is loaded with cut sheets one by one by the operator, the single-page printing mode is desirable. If the printing is effected on a web which has preforations for separation into sheets, the continuous mode is preferred. For the above reason, the single-page and continous printing modes are generally provided.

In the case where the printer is equipped with a sheet feeder, it is convenient to adapt the printer such that a print-mode default value is set so as to normally select the continuous mode, and such that the single-page mode is established only when the operator manipulates a mode selector, desiring to achieve printing in the single-page mode.

If the printer is adapted to be equipped with an optionally available sheet feeder, the setting of the above-indicated default value for selection of the continuous printing mode will automatically establish the continous printing mode even on the printer which is marketed without the sheet feeder. Therefore, the operator must manipulate the mode selector to establish the single-page mode each time the printer is turned on. Thus, the above setting results in reduced ease of operation for such printers.

Conversely, the setting of the print-mode default value so as to normally select the single-page mode will improve the ease of operation for the printers not equipped with a sheet feeder, but will give rise to the above-indicated operational inconvenience for the printers equipped with a sheet feeder.

SUMMARY OF THE INVENTION

It is therefore an object of the present invention to provide a printer adapted to be optionally equipped with a sheet feeder, wherein the print-mode default value is automatically set so as to normally select one of two different printing modes, depending upon whether the printer is equipped with the sheet feeder or not, and wherein the automatically selected printing mode may be changed by the operator if desired.

The above object is achieved by the present invention which provides a printer which is equipped with a printing mechanism, and printing control means for controlling the printing mechanism based on text data supplied from text-data supply means, and which is adapted to be optionally equipped with a sheet feeder for feeding cut sheets, the printer comprising detector means for detecting the presence of the sheet feeder on the printer, default-value setting means, and operator-controlled default-value changeover means.

The detector means generates a feeder-presence signal indicative of the presence of the sheet feeder when the sheet feeder is detected, and a feeder-absence signal indicative of the absence of the sheet feeder when the sheet feeder is not detected.

The default-value setting means is responsive to the feeder-presence signal, for automatically setting a default value of the printing control means to a value for establishing a continous printing mode. The default-value setting means is responsive to the feeder-absence signal, for automatically setting the default value to a value for establishing a single-page printing mode. In the continuous printing mode, the printing mechanism is automatically activated to perform a top-of-form action after the completion of printing of the last line on each cut sheet. In the single-page printing mode, the printing mechanism is automatically stopped after the printing of the last line on each cut sheet.

The default-value changeover means is used by the operator to change the default value from the value set by the default-value setting means, to the other value.

In the printer of the invention having an automatic print-mode setting device as described above, the sheet feeder if installed in position on the printer is detected by the detector means, and the default-value setting means is accordingly operated to set the default value so as to establish the continous printing mode. If the sheet feeder is not provided, the detector means generates the feeder-absence signal, and the default-value setting means is operated in response to this signal to set the default value so as to establish the single-page printing mode. Further, if the default-value changeover means is operated by the operator, the automatically established printing mode is changed to the other printing mode.

As described above, the printer is automatically placed in the continuous printing mode when the printer is turned on, if the printer is equipped with the sheet feeder. If the sheet feeder is not provided or not installed in position, the printer is automatically placed in the single-page printing mode. According to this arrangement, there is only a minimum of need to change the normally selected printing mode from one mode to the other. The printing operation of the printer equipped with the sheet feeder is performed in the continuous mode in almost all cases. On the other hand, the printing operation of the printer without the sheet feeder is generally effected in the single-page mode. Another advantage of the instant arrangement is offered by the operator-controlled default-value changeover means, which enables the operator to replace the automatically selected printing mode by the other mode, if desired for any reason, thereby increasing the operating flexibility of the printer.

According to one advantageous feature of the invention, the detector means comprises a cable for electrical connection of the sheet feeder to the printer, and a connector for connecting the cable to one of the sheet feeder and the printer. The feeder-presence signal and the feeder-absence signal are generated depending upon whether the connector is installed in place or not.

In one form of the above feature of the invention, the detector means comprises a first lead connected via a fixed resistor to a high-level voltage source provided in the printer, and a second lead grounded on the side of the sheet feeder. The first and second leads are connected to each other when the connector is installed in place. The feeder-presence signal is generated when a voltage level of the first lead becomes low as a result of connection of the first lead to the second lead.

According to another advantageous feature of the invention, the default-value setting means comprises a program memory which stores a program for automatic setting of the default value, and a processing unit for executing the program.

According to a further feature of the invention, the text data is supplied from an external device. Namely, the printer is not provided with the text-data supply means.

According to an alternative arrangement, the printer further comprises a text memory for storing the text data, and a keyboard having a multiplicity of keys for entering the text data into the text memory. In this case, the printer serves as a part of a typewriter which includes the keyboard and the text memory. The default-value changeover means may comprise at least one of the multiplicity of keys on the keyboard.

BRIEF DESCRIPTION OF THE DRAWINGS

The above and other objects, features and advantages of the present invention will become more apparent by reading the following detailed description of a preferred embodiment of the invention, when considered in connection with the accompanying drawings, in which:

FIG. 4 is a flow chart showing a control program associated with the present invention, which is executed when the typewriter is placed in its printing mode; and.

DETAILED DESCRIPTION OF THE PREFERRED EMBODIMENT

Referring to the accompanying drawings, a preferred embodiment of the invention will be described in detail.

Figure 1:
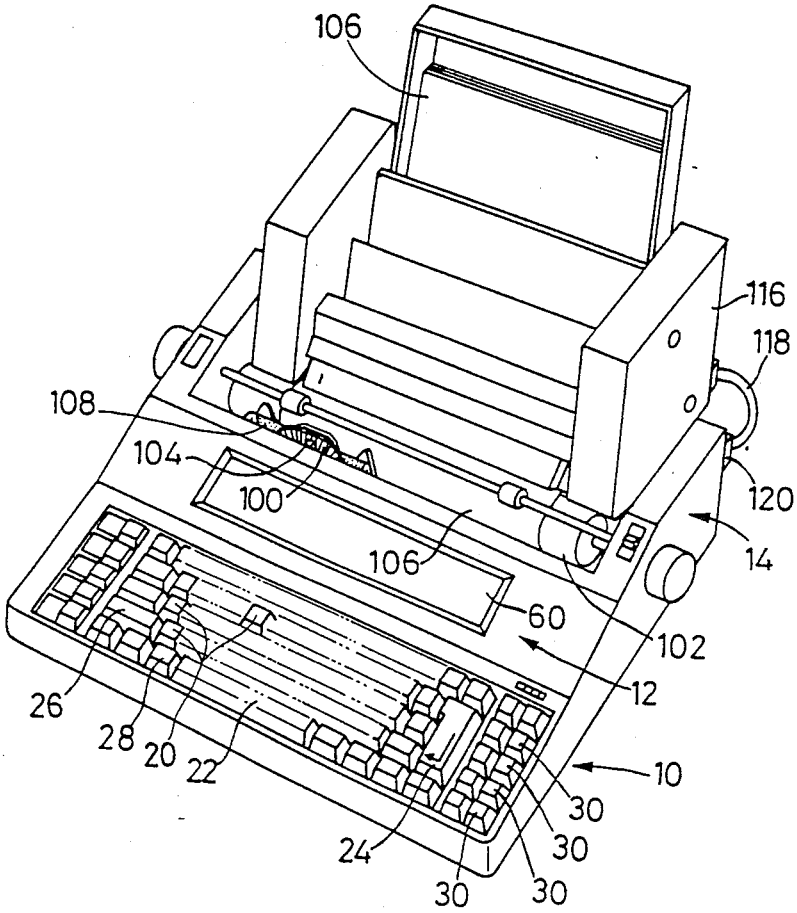
FIG. 1 is a perspective view of one embodiment of a printer of one embodiment of the present invention in the form of a typewriter.

Referring first to FIG. 1, there is shown a typewriter having word processing capability, which incorporates a printer according to one embodiment of the invention for performing a printing operation based on a text data stored in a text memory 74 (which will be described).

The typewriter is provided with a keyboard 10 at its front, and a display device 12 and a printing mechanism 24 disposed behind the keyboard 10.

The keyboard 10 has a multiplicity of character keys 20 for entering characters such as alphabetic letters, numerals and various symbols, and many function keys such as a space bar 22, a carriage return key 24, a shift key 26, a code key 28, and cursor keys 30.

Figure 2:
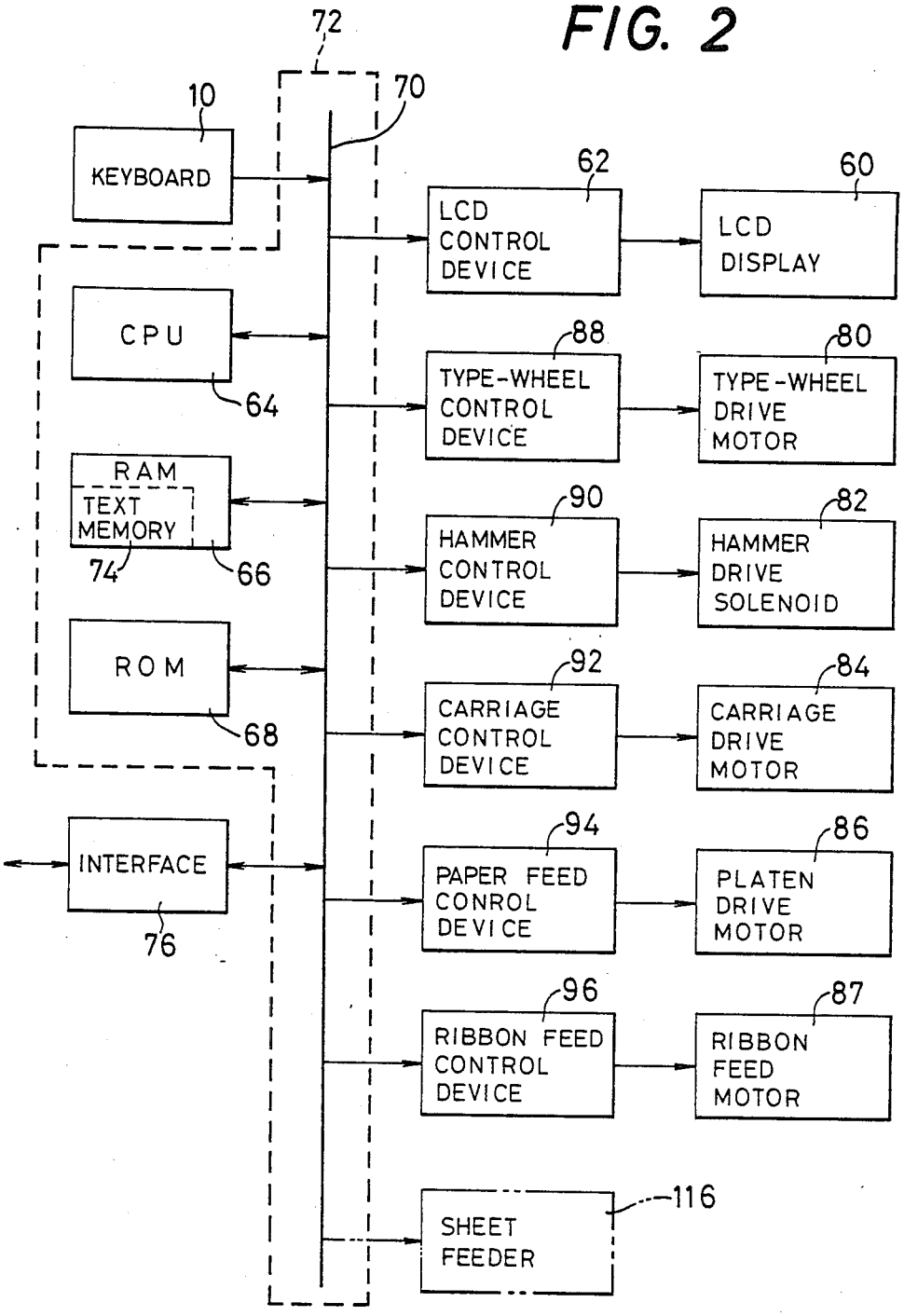
FIG. 2 is a block diagram showing a control system of the typewriter.

The display 12 uses a liquid crystal display (LCD) 60. As shown in FIG. 2, this LCD 60 is connected to a LCD control device 62 which is operated under the control of a computer 72. The computer 72 incorporates a CPU 64 (central processing unit), a RAM 66 (random-access memory), a ROM 68 (read-only memory) and data bus 70. The LCD 60 controlled by the LCD control device 62 is adapted to provide a menu which lists various modes of operation of the typewriter that are selectable by the operator through the keyboard 10. Further, the LCD 60 is adapted to display a portion of a text which is entered through the keyboard 10 and stored in the above indicated text memory 74 provided in the RAM 66. The LCD 60 also displays various messages from the typewriter to the operator. The RAM 66 is also used to store text data which are supplied from an external device through an interface 76.

The printing mechanism 14 has various drive sources including a type-wheel drive motor 80, a hammer drive solenoid 82, a carriage drive motor 84, a platen drive motor 86 and a ribbon feed motor 87, as depicted in FIG. 2. These drive sources for the printing mechanism 14 are controlled according to control commands from the computer 72, via the corresponding control devices, i.e., a type-wheel control device 88, a hammer control device 90, a carriage control device 92, a paper feed control device 94 and a ribbon feed control device 96. Thus, the printing operation is effected. A type wheel 100 shown in FIG. 1 is mounted on the output shaft of the type-wheel drive motor 80 mounted on a carriage (not shown). The type wheel 100 has 96 radial arms which carry at their ends respective type fonts. With the type-wheel drive motor 80 rotated by a suitable angle according to the text data, the type wheel 100 is indexed to bring the desired one of the type fonts into the printing position aligned with a line of printing on the platen 102. A hammer 104 is provided on the carriage, such that the hammer is disposed in front of the type font at the printing position. The hammer 104 is activated by the above-indicated hammer drive solenoid 82, thereby impacting the selected type font against a cut sheet 106 supported on the platen 102, via a ribbon 108 which is fed by the ribbon feed motor 87. In this way, the character corresponding to the impacted type font is printed on the sheet 106, as is well known in the art. The type-wheel drive motor 80, the type wheel 100 and the hammer 104 cooperate with other elements to constitute a print head 110 which is mounted on the carriage. The carriage is reciprocated along the axis of the platen 102 by the above-indicated carriage drive motor 84, whereby the print head 110 is moved right and left relative to the sheet 106, in the longitudinal direction of the platen 102. The sheet 106 is fed up and down with the platen 102 rotated by the platen drive motor 86. With the feeding movements of the sheet 106 and the print head 110, the printing position on the sheet 106 can be changed or shifted.

The instant typewriter is adapted to be optionally equipped with a sheet feeder 116 as shown in FIG. 1. This sheet feeder 116 incorporates a control circuit (not shown) which controls the operation of a paper feed motor to rotate feed rollers for feeding the cut sheets 106 one after another to the typewriter.

Figures 3, 5:
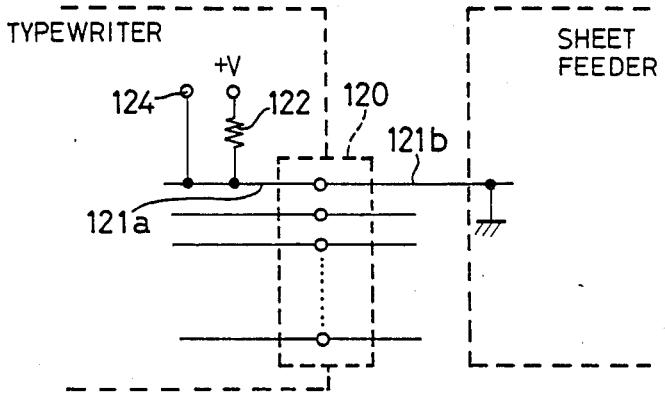
FIG. 3 is a circuit diagram showing detector means for sensing installation of a cut-sheet feeder on the typewriter.
FIG. 5 is a view showing an example of a display on a liquid crystal display device provided on the typewriter.

The control circuit of the sheet feeder 116 is connected to the typewriter by means of a cable 118 and a connector 120, for interactive data communication between the computer 72 and the control circuit, so as to supply the sheets 106 to the typewriter at the appropriate times. The cable 118 is connected at its one end to the sheet feeder 116, and at its other end to the connector 120. The electrical connection of the connector 120 to the typewriter will automatically cause the computer 72 to detect the electrical connection of the sheet feeder 116 to the typewriter, i.e., installation of the sheet feeder 116 in place on the typewriter. As indicated in FIG. 3, the typewriter has a first lead 121*a* which is connected via a fixed resistor 122 to a high-level voltage source (+V) provided in the typewriter. This first lead 121*a* is connected via the connector 120 to a second lead 121*b* of the cable 118 when the connector 120 is electrically connected to the typewriter. The second lead 121*b* is grounded on the side of the sheet feeder 116. A signal port 124 provided in the typewriter is connected to the first lead 121*a*. According to this arrangement, when the connector 120 is connected to the typewriter, a low-level signal is present at the signal port 124. This low-level signal serves as a feeder-presence signal indicating that the sheet feeder 116 is electrically connected to the typewriter. With the connector 120 not connected to the typewriter, a high-level signal is present at the signal port 124, which serves as a feeder-absence signal indicating that the sheet feeder 116 is not connected to the typewriter. Thus, the connector 120, the fixed resistor 122 and the signal port 124 constitute a major part of a detector for detecting the electrical connection of the sheet feeder 116, that is, a detector for sensing that the sheet feeder 116 is installed for feeding the cut sheets 106 one after another for continuous printing thereon.

Figure 4:
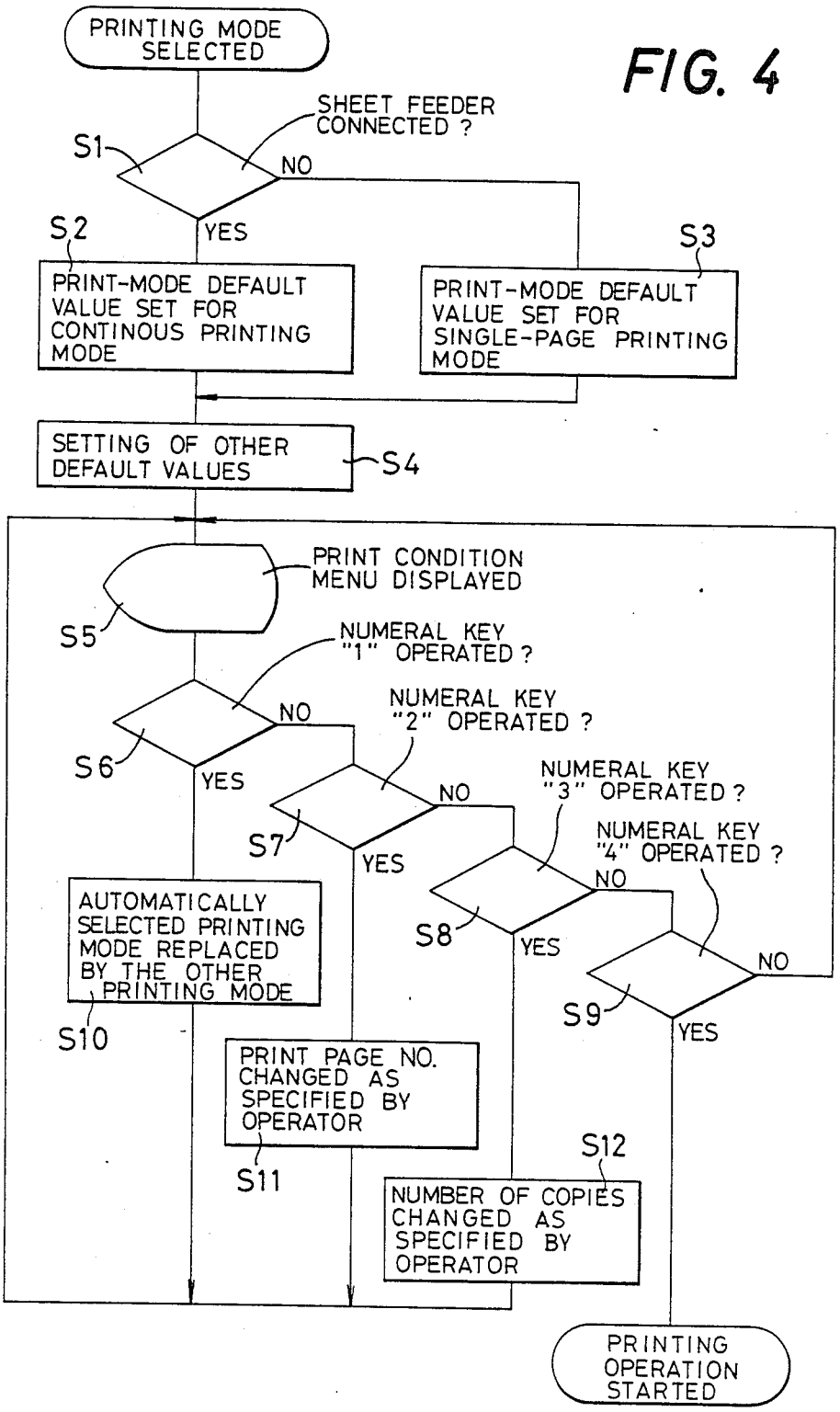

The ROM 68 of the computer 72 stores control programs for controlling the operation of the present typewriter. The control program closely associated with the present invention is illustrated in the flow chart of FIG. 4. As is apparent from the flow chart, the CPU 64 executes step S1 when the typewriter is placed in the printing mode. In step S1, the CPU 64 checks, based on the level of the signal at the signal port 124, to see if the sheet feeder 116 is electrically connected to the typewriter or not. If the sheet feeder 116 is connected to the typewriter, the CPU 64 goes to step S2 to set a print-mode default value to a value for establishing a continous printing mode in which the printer initiates a top-of-form action after the printing of the last line on the current sheet 106, in order to feed the next sheet 106 into the printing position. If the sheet feeder 116 is not connected to the typewriter, the CPU 64 executes step S3 to set the default value to a value for establishing a single-page printing mode in which the printer is stopped after the printing of the last line on the sheet 106 supplied by the sheet feeder 116, or on a sheet manually supplied by the operator.

Subsequently, step S4 is executed to set other default values which will be described in connection with steps S5, S11 and S12. Step S4 is followed by step S5 in which a print condition menu as indicated in FIG. 5 is displayed on the LCD 60. If the continous printing mode has been established in step S2, a message "1. Pause after each page:" indicating the printing mode is followed by "N". If the single-page printing mode has been established in step S3, the message "1. Pause after each page:" is followed by "Y". The other messages indicating the first and last print page numbers, and the number of copies are also displayed according to the corresponding default values set in step S4.

Thereafter, steps S6, S7, S8 and S9 are repeatedly executed, waiting for data entry by the operator. If the operator desires to change the printing mode automatically selected in step S2 or S3, the character key 20 corresponding to numeral "1" is operated, whereby the answer to the checking in step S6 becomes affirmative (YES). Consequently, the CPU 64 goes to S10 in which the automatically selected printing mode can be replaced by the other printing mode. If the character key 20 corresponding to numeral "2" or "3" is operated, the answer to the checking in step S7 or S8 becomes affirmative, and the CPU 64 executes step S11 or S12 in which the first and last print page numbers or the number of copies that has been set in step S4, can be changed as specified by the operator.

If the operator operates the character key 20 corresponding to numeral "4" after or without changing any automatically set default value or values, the answer to the checking in step S9 becomes affirmative (YES), and the printing operation is initiated. The printing operation is performed with the type-wheel drive motor 80 and the other appropriate drive motors being controlled via the corresponding control devices 88, etc., by the printing control means which includes the CPU 64 and a portion of the ROM 68 which stores the printing control programs. The printing operation with the daisy type wheel 100 is performed in a manner well known in the art.

In the illustrated embodiment as described above in detail, the electrical connection of the sheet feeder 116 is detected by detector means which includes the connector 120, cable 118 (second lead 121*b*), first lead 121*a*, fixed resistor 122 and signal port 124. The typewriter is automatically placed in the continuously printing mode if the sheet feeder 116 is found connected to the typewriter, while the printer is automatically placed in the single-page printing mode if the sheet feeder 116 is not found connected to the typewriter. In the illustrated embodiment, the CPU 64, and a portion of the ROM 68 which stores the programs for executing steps S1–S3, constitute automatic default-value setting means for automatically setting the print-mode default value. If the operator wishes to change the automatically set print-mode default value to the other value, the operator operates the character key 20 corresponding to numeral "1". With this key 20 operated, it is possible to change the print-mode message on the LCD 60 and the automatically set print-mode default value, by using the cursor keys 30 and the character key 20 corresponding to alphabetic letter "N" or "Y". In this embodiment, the character keys 20 corresponding to numeral "1" and letters "N" and "Y", and the cursor keys 30 constitute operator-controlled default-value changeover means for changing the print-mode default value.

Although the text memory 74 incorporated in the illustrated typewriter serves as text-data supply means for supplying text data representative of a text to be printed, the principle of the invention may be applied to a printer which is adapted to perform a printing operation according to text data supplied from an external device. In this case, the external device serves as the text-data supply means.

While the present invention has been described in its preferred embodiment for illustrative purpose only, it is to be understood that the invention may be embodied with various modifications and improvements which may occur to those skilled in the art.

What is claimed as new and desired to be secured by Letters Patent of the United States is:

1. A printer having an automatic print-mode setting device, and adapted to be optionally equipped with a sheet feeder for supplying cut sheets to the printer one after another, said printer comprising:

a printing mechanism for effecting a printing operation according to text data representative of a text to be printed;

printing control means for controlling said printing mechanism based on said text data;

detector means for detecting the presence of said sheet feeder on the printer, said detector means generating a feeder-presence signal and a feeder-absence signal which are indicative of the presence and absence of said sheet feeder, respectively;

default-value setting means responsive to said feeder-presence signal, for automatically setting a default value of the printing control means to a value for establishing a continous printing mode in which said printing mechanism is automatically activated to perform a top-of-form action after the completion of printing of the last line on each cut sheet, said default-value setting means being responsive to said feeder-absence signal, for automatically setting said default value to a value for establishing a single-page printing mode in which said printing mechanism is automatically stopped after the printing of the last line on each cut sheet; and operator-controlled default-value changeover means for changing the default value from the value set by said default-value setting means, to the other value.

2. The printer of claim 1, wherein said detector means comprises a cable for electrical connection of said sheet feeder to said printer, and a connector for connecting said cable to one of said sheet feeder and said printer, said feeder-presence signal and said feeder-absence signal being generated depending upon whether said connector is installed in place or not.

3. The printer of claim 2, wherein said detector means comprises a first lead connected via a fixed resistor to a high-level voltage source provided in said printer, and a second lead grounded on the side of said sheet feeder, said first and second leads being connected to each other when said connector is installed in place, said feeder-presence signal being generated when a voltage level of said first lead becomes low as a result of connection of said first lead to said second lead.

4. The printer of claim 1, wherein said default-value setting means comprises a program memory which stores a program for automatic setting of said default value, and a processing unit for executing said program.

5. The printer of claim 1, wherein said text data is supplied from an external device.

6. The printer of claim 1, further comprising a text memory for storing said text data, and a keyboard having a multiplicity of keys for entering said text data into said text memory, said printing mechanism and said printing control means cooperate with said keyboard and said text memory to constitute a typewriter.

7. The printer of claim 6, wherein said operator-controlled default-value changeover means comprises at least one of said multiplicity of keys on said keyboard.

* * * * *